US010807773B2

(12) United States Patent
Bois et al.

(10) Patent No.: US 10,807,773 B2
(45) **Date of Patent: *Oct. 20, 2020**

(54) CONTAINER

(71) Applicant: CLARIANT HEALTHCARE PACKAGING (FRANCE) S.A.S, Choisy le Roi (FR)

(72) Inventors: Dominique Bois, Montreuil aux Loins (FR); Valere Logel, Levallois Perret (FR)

(73) Assignee: Clariant Healthcare Packaging (France) S.A.S., Choisy le Roi (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/323,480

(22) PCT Filed: Jul. 1, 2015

(86) PCT No.: PCT/EP2015/064955
§ 371 (c)(1),
(2) Date: Jan. 3, 2017

(87) PCT Pub. No.: WO2016/005240
PCT Pub. Date: Jan. 14, 2016

(65) Prior Publication Data

US 2017/0144804 A1 May 25, 2017

(30) Foreign Application Priority Data

Jul. 8, 2014 (EP) ..... 14306112

(51) Int. Cl.
*B65D 43/16* (2006.01)
*B65D 43/02* (2006.01)
(Continued)

(52) U.S. Cl.
CPC ..... *B65D 43/169* (2013.01); *A61J 1/03* (2013.01); *B65D 43/021* (2013.01); *B65D 53/00* (2013.01)

(58) Field of Classification Search
CPC ..... A61J 1/03; B65D 43/16; B65D 43/163; B65D 43/169
(Continued)

(56) References Cited

U.S. PATENT DOCUMENTS 3,817,420 A 6/1974 Heisler
4,004,710 A 1/1977 Crisci
(Continued)

FOREIGN PATENT DOCUMENTS

CN 102795392 A 11/2012
EP 0454967 A2 11/1991
(Continued)

OTHER PUBLICATIONS

International Search Report with Written Opinion dated Sep. 1, 2015 with respect to International Application No. PCT/EP2015/064955.
(Continued)

*Primary Examiner* — Robert Poon
(74) *Attorney, Agent, or Firm* — Scott R. Cox

(57) ABSTRACT

A container for loosely stored products including
a) a container body containing a peripheral body wall having an inner peripheral body groove;
b) a cover containing a cover skirt having an outwardly facing sealing portion with an apex that seals against the inner peripheral body groove when the cover is in a closed condition thereby forming a seal of a sealing line type; and
c) a hinge connecting the container body and the cover. The apex of the cover skirt and the inner peripheral body
(Continued)

Figure 1:
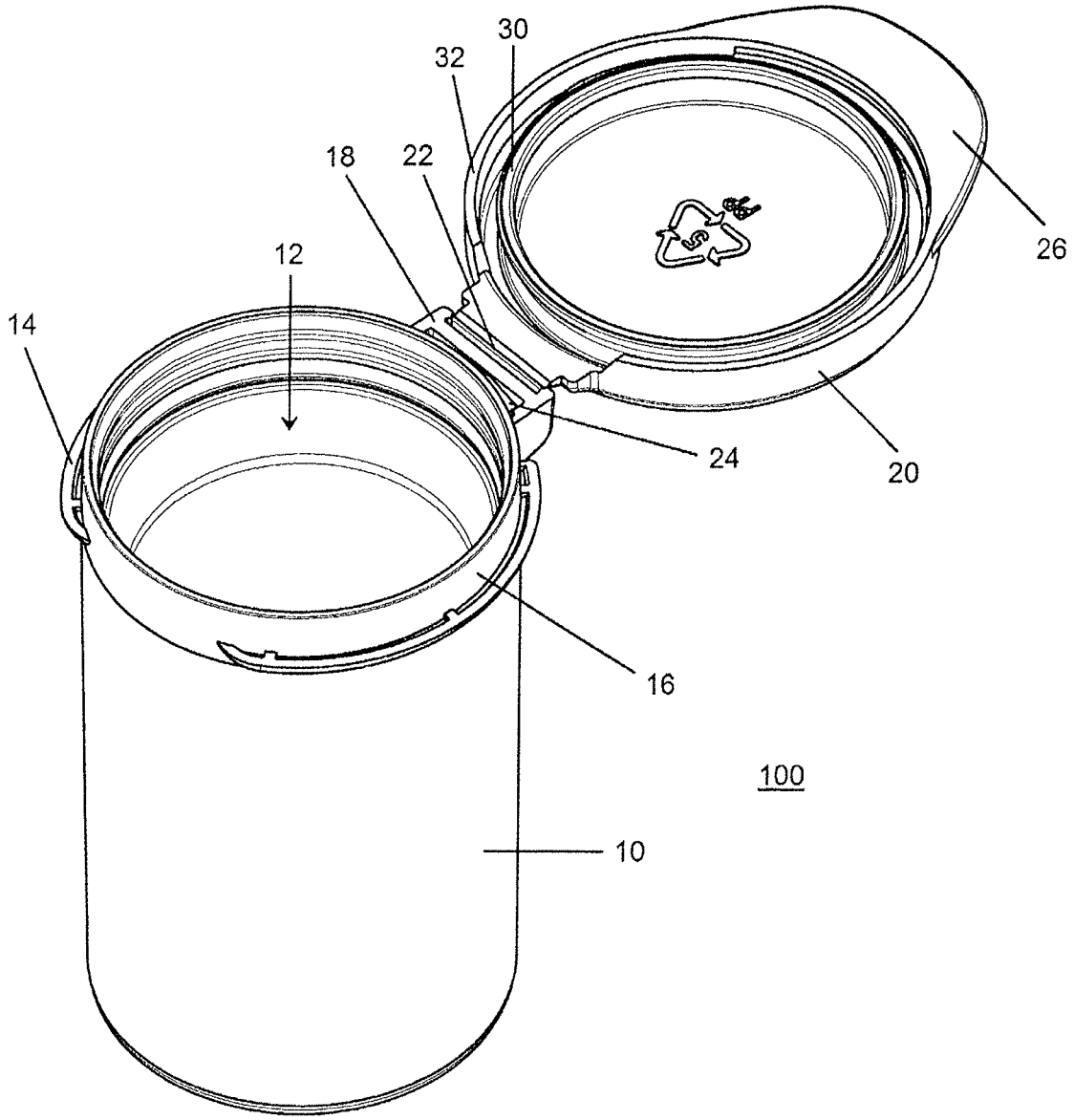

groove provide the only seal between the cover and the container body and preferably the only locking element that holds the cover in the closed condition on the container body.

14 Claims, 4 Drawing Sheets

(51) Int. Cl.
*A61J 1/03* (2006.01)
*B65D 53/00* (2006.01)

(58) Field of Classification Search
USPC ..... 220/795, 849, 803, 800, 801, 806
See application file for complete search history.

(56) References Cited

U.S. PATENT DOCUMENTS

| | | | | |
|---|---|---|---|---|
| 4,030,850 | A * | 6/1977 | Hyde | B65D 90/08 220/795 |
| 4,165,020 | A | 8/1979 | Hoselton | |
| 4,639,386 | A | 1/1987 | Akao | |
| 4,834,234 | A | 5/1989 | Sacherer et al. | |
| 5,637,364 | A | 6/1997 | Akao et al. | |
| 5,720,389 | A * | 2/1998 | Yamazaki | B65D 25/10 206/316.1 |
| 6,769,558 | B1 | 8/2004 | Bucholtz | |
| 6,834,770 | B2 * | 12/2004 | Lo | B65D 90/545 138/89 |
| 7,661,547 | B2 | 2/2010 | Richir | |
| 7,952,479 | B2 | 5/2011 | Portier et al. | |
| 7,993,071 | B2 | 8/2011 | Clawson | |
| 8,006,368 | B2 | 8/2011 | Logel et al. | |
| 8,685,346 | B2 | 4/2014 | Logel et al. | |
| 8,783,485 | B2 | 7/2014 | Logel et al. | |
| 8,800,809 | B2 | 8/2014 | Portier | |
| 9,428,311 | B2 * | 8/2016 | Bois | B65D 43/169 |
| 9,861,926 | B2 | 1/2018 | Lebon et al. | |
| 2007/0084735 | A1 | 4/2007 | Lancesseur et al. | |
| 2011/0000930 | A1 * | 1/2011 | Logel | B65D 43/162 220/849 |
| 2011/0226643 | A1 * | 9/2011 | Kates | A61B 5/14532 206/305 |
| 2015/0232242 | A1 | 8/2015 | Carlson et al. | |
| 2015/0259115 | A1 * | 9/2015 | Yeh | B65D 51/30 206/204 |

FOREIGN PATENT DOCUMENTS

| | | | |
|---|---|---|---|
| EP | 0 454 967 | B1 | 12/1995 |
| EP | 2 634 108 | A1 | 9/2013 |
| EP | 2 949 592 | A1 | 12/2015 |
| JP | H01113235U | U | 7/1989 |
| JP | H01113238U | U | 7/1989 |
| JP | H06-027593 | A | 2/1994 |
| NO | WO2005074571 | A2 | 8/2005 |

OTHER PUBLICATIONS

Notice of Opposition to related European Patent No. 2966000 (patent application No. 143061125) filed by CSP Technologies, Inc. against Clariant Production (France) SAS dated May 30, 2017. Information regarding references cited in the Notice of Opposition: (1) D3 was cited in an Information Disclosure Statement filed Jan. 25, 2017.

English Translation of Japanese Office Action dated Nov. 29, 2017 with respect to parallel Japanese Patent Application No. 2016-576044.

English translation of Chinese Office Action dated Jun. 22, 2018 with respect to parallel Chinese patent application 201580036943.2.

Wikimedia Foundation, Inc., "Hermetic seal" Sep. 1, 2019, [cited Apr. 2, 2019] Available from: [https://en.wikipedia.org/w/index.php?title=Hermetic_seal&oldid=877587167].

Notice filed in Opposition proceeding to European Patent No. EP296000 (patent application No. EP 14306112.5) filed by CSP Technologies, Inc. Mar. 19, 2019—cited for references disclosed therein.

* cited by examiner

CONTAINER

FIELD OF THE INVENTION

The present invention relates to a container for receiving loosely stored products, such as drugs, pills, tablets, test strips, granulate and even powder which has a container body and a cover, connected by a hinge. For such purposes the container has to be airtight in order to avoid a deterioration of the stored products even after the container has been opened and closed several times.

PRIOR ART

Containers of the above mentioned type are known and common to the skilled in the art. They usually comprise a cover that is integrally attached to the container, wherein the cover has a circular base with an outer periphery and a cylindrical tubular skirt extending perpendicularly and outwardly around the outer periphery of the base. Furthermore such containers have also an upper portion and an inner and outer surface, wherein the container having a cylindrical upstanding rim at the upper portion, the rim is defined as that portion of the container that contacts an inner wall of the skirt of the cover, and the rim having an inner and outer wall rim. Further, such covers comprise a thumb tab for facilitating the opening and closing of the container and at least one hinge attached to the container. The hinge has at least one hinge recess bend point that functions to rotate the cover at one pivot point. The thumb tab and the hinge are positioned on substantially opposing ends of the cover and extending, perpendicularly and outwardly from the skirt of the cover.

A flexible lip is often part of such containers, whereby the flexible lip is a projection that projects concentrically from an interior surface of the base of the cover. When the skirt of the cover overlies the container and at least a portion of the rim of the container engages the inner wall of the skirt of the cover, the flexible lip interacts with the rim to sufficiently deflect so as to form a releasable seal between the cover and the container.

One of the main criteria of such containers is the air tightness in order to protect the stored products as good as possible. Improved demands in this respect require a very exact manufacturing of the containers particular the sealing portions. In prior art containers reliability of the containers can not be guaranteed due to manufacturing defects at the sealing portions.

Further, since such containers with hinged covers are intended to be opened and closed several times mainly by hand this may again impair air tightness of the container according the prior art.

WO 2005/074571 A2 discloses an integral container and cap assembly wherein a hinge is placed between the container body and the cap. A flexible lip projects concentrically from an interior surface of the base of the cap.

The resealable container according to U.S. Pat. No. 6,769,558 B1 consists essentially of a container having a rim at its upper portion, and a cap having a circular base with an outer periphery, a cylindrical tubular skirt, the inner wall of which has at least one recess, and a hinge connecting the cap to the container. In a closed position, the skirt of cap overlies the container and the rim of the container is situated within the recess of the inner wall of the skirt of the cap.

Based on the explained disadvantages as well as by considering the explained prior art for containers of the above mentioned art, the aim of this invention is to provide a container of the above mentioned type, which has an improved tightness even when opened and closed several times, can be easily manufactured and provides an improved reliability.

SUMMARY OF THE INVENTION

This goal is achieved according to the invention as defined in the independent claim. Advantageous but optional improvements result from the subject matter of the sub claims.

Particularly the invention provides a container for loosely stored products comprising a container body, a cover and a hinge, connecting the container body and the cover. The container body comprises a peripheral body wall having an inner peripheral body groove. The cover has a cover skirt having an outwardly facing sealing portion with an apex that seals against the inner peripheral body groove when the cover is in a closed condition thereby forming a seal of a sealing line type. In one embodiment, the apex of the cover skirt and the inner peripheral body groove provides the only seal between the cover and the container body and preferably the only locking element that holds the cover in the closed condition on the container body.

According to one aspect, the sealing portion may form a sealing line that seals against the inner peripheral body groove when the cover is in a closed condition. In one embodiment, the seal between the apex of the cover skirt of the cover and the inner peripheral body groove of the container body provides at the same time the only seal and the locking element that holds the cover in the closed condition on the container body. More particularly, the locking element creates an interlocking between the cover and the container body. For holding the cover in a closed condition, the inner peripheral body groove and the apex cooperating with this peripheral body groove provide a resistance to opening which resistance is more than the usual frictional resistance of an apex pressed against a flat surface. It allows to avoid undesired opening of the cover and to establish a controlled, predetermined opening force.

A sealing line is a seal that concentrates on a thin or limited contact area. This sort of seal is opposed to a surface seal which is a seal that aims at maximizing the contact area. The "sealing line" or "line seal" may increase the efficiency and the quality of airtightness by offering a very well defined contact area. Further, a line seal limits the frictional forces at the seal interface and is, therefore, more appropriate for a container designed for multiple opening and closing operations. A "line seal" is to be understood as a thin sealing line preferably having a thickness of 0.5 mm or less, more preferably from 0.05 to 0.3 mm. A "surface seal" has a larger thickness if compared to a "line seal".

According to one aspect, the container may comprise a container body having a peripheral body wall, wherein a peripheral body groove is defined in an inner surface of the peripheral body wall. It may further comprise a cover having a cover skirt, wherein an apex is formed on an outer surface of the cover skirt, wherein the apex cooperates with the peripheral body groove so as to form a line seal between the cover and the container body when the cover is in a closed condition and so as to hold the cover in the closed condition on the container body. It may further comprise a hinge connecting the container body and the cover, the hinge allowing a pivoting of the cover relative to the container body. In one embodiment, the container comprises no seal between the container body and the cover and no locking element for holding the cover in the closed condition on the container body other than the apex cooperating with the peripheral body groove.

The apex may cooperate only with the inner peripheral body groove and not with an additional protrusion. This cooperation of the apex and the inner peripheral body groove may be sufficient for locking the cover on the container so that the container may comprise no further locking element. In this connection, the hinge is not to be understood as a locking element.

A specific structure that results in an improved performance of the container is the combined function of the seal and the locking element on a thin surface. Compared to the prior art, a lock distributed over the periphery of the container is more effective than a lock placed on a limited part, e. g. placed behind, below the thumb tab but not all over the circumference of the container. Compared to the prior art, the fact that there is a single line seal and lock, instead of different contacts creating further interference surfaces, provides for a more reliable airtightness independently of any variation in dimensional tolerance of all these surfaces during manufacture.

Preferably, the cover may comprise an outer peripheral cover wall situated radially outside of the cover skirt and radially outside of the peripheral body wall. The outer peripheral cover wall may protect the apex of the sealing portion of the cover skirt against contact when the cover is in an opened condition. However, the cover may alternatively not be provided with an outer peripheral cover wall in addition to the cover skirt.

Further preferably, the cover may comprise a top wall from which the cover skirt and the outer peripheral cover wall may extend. A vertical distance of the apex of the sealing portion may preferably be smaller than a vertical extension of the outer peripheral cover wall.

Since the sealing portion may be provided at an outer edge of the cover skirt and the vertical distance of the apex of the sealing portion may be smaller than the vertical extension of the outer peripheral cover wall, the sealing portion may be protected against undesired contact by means of the outer peripheral cover wall. Even if the container is shipped or handled in open state the sealing portion of the cover may be protected against damages. This may increase air tightness of the container and overall reliability due to fail safe handling.

The apex or sealing line of the sealing portion may be arranged within a clearance formed between the cover skirt and the outer peripheral cover wall. This clearance may usually be very narrow, such that it is unlikely that the apex of the sealing portion at the cover skirt is contacted or even damaged.

In a preferred embodiment the vertical distance A of the apex of the sealing portion from the top wall may be 2.0-15.0 mm, preferably 2.0-10.0 mm, more preferably 3.9 mm, and the vertical extension B of the outer peripheral cover wall may be 2.1-15.1 mm, preferably 2.1-10.1 mm, more preferably 4.2 mm. The apex of the sealing portion can be protected by a preferably 0.3 mm higher outer peripheral cover wall.

Preferably, the peripheral body wall may, when viewed from a top side, have rounded, for example oval or circular, surfaces. Rounded surfaces may be surfaces without sharp corners. Further, the container body may have a cylindrical shape. A cylindrical shape is not only a circularly cylindrical shape but also a shape of a cylinder with a non-circular base. The container can generally have any shape.

Preferably, the container body comprises an obstacle that stops the cover when said cover is closed, e. g. by abutting the cover against an obstacle which can have the form of a projection or similar. For example, when the cover is provided with an outer peripheral cover wall, the obstacle may be a bead extending outwardly from the wall of the container body. In the absence of an outer peripheral cover wall, the obstacle may be a stop on the upper end of the peripheral body wall of the container that interferes with the top wall of the cover.

Preferably, the inner peripheral body groove may have a depth of between 0.05 mm and 0.7 mm, more preferably a depth of between 0.1 mm and 0.5 mm, still further preferably a depth of between 0.15 mm and 0.4 mm.

In particular, the skirt outer diameter (da) of the cover skirt at a position of the apex may be greater than a peripheral body wall inner diameter (dg) of the container body at a position of the peripheral body groove. Further, the skirt outer diameter (da) and the peripheral body wall inner diameter (dg) may satisfy the equation $da=dg+x$, where x is 0.05 mm to 1.5 mm, preferably 0.1 mm to 1 mm.

In a preferred embodiment, the peripheral body groove may define a groove radius in a cross section of the peripheral body wall and the apex of the sealing portion may define an apex radius in a cross section of the cover skirt, wherein the groove radius may be greater than the apex radius.

In a further embodiment, the sealing portion seen in the cross section of the cover skirt may be provided with a first radius R1, which is the before-mentioned apex radius, defining the apex. In an embodiment the first radius R1 may be 0.5-3.0 mm, preferably 0.7-0.9 mm and more preferably 0.8 mm.

When the sealing portion comprises a rather small radius, a well defined contact line with the inner wall surface of the container body may result which may guarantee on the one hand an improved air-tightness and may on the other hand allow opening and closing of the container without damaging the sealing portion.

In a further embodiment, the sealing portion may comprise a second radius R2 between the first radius R1 and an end surface of the cover skirt, wherein the second radius R2 may be smaller than the first radius R1. In an embodiment the second radius R2 may be 0.05-2.0 mm, preferably 0.10-0.50 mm and more preferably 0.15 mm.

This second radius may additionally eliminate the risk of damaging the inner wall surface of the peripheral body wall of the container body and thereby improves again airtightness of the container.

Preferably, the inner wall may further comprise a third radius R3 between a wall surface of the cover skirt and the sealing portion. In an embodiment the third radius R3 may be 1.0-3.0 mm, preferably 1.5 mm. This third radius may facilitate the production since it may avoid any risk of scratching the sealing portion surface when ejecting the cover from its mould.

In a further preferred embodiment the thickness T of the cover skirt may be between 0.4-1.2 mm, preferably about 0.7 mm. The thickness of the cover skirt may be chosen to optimize on the one hand the compression force the sealing portion exerts to the inner surface of the peripheral body wall of the container. On the other hand, it has been found out that it is favourable to avoid material accumulations at the sealing portion since the sealing portion is—time wise—the last portion of the injection mould that is filled. By reducing the wall thickness material accumulations may be avoided and subsequently material defects like sink marks may be avoided. It was found out that the less material is used at the sealing portion the better the final geometry and the better the air tightness of the final container may be.

Preferably, the cover skirt may further comprise a chamfer opposite to the sealing portion. Since the sealing portion of the inner wall may comprise a radius which forms an apex at the outer side a chamfer at the inner side may be provided which may locally eliminate the increase of the wall thickness in this area. The chamfer therefore may further prevent a material accumulation, may prevent material defects like sink marks and may thereby increase the air tightness of the container.

In one embodiment, the container body and the cover may be made in one piece. In another embodiment, the cover may be detachably connected to the container body.

Said cover may be produced independently and separately from said container body. This may allow producing the cover of a different material than the container body which may further increase air tightness of the container due to a special material selection of both parts.

Further, it may be preferred that the cover skirt is a separate piece of the cover. Such embodiment may allow for tailoring the material of the cover skirt, in particular the apex of the sealing portion to be particularly suitable for its function as providing the seal and the locking element. At the same time, the remaining parts of the cover may use a material which can be tailored to its function such as rigidity, mechanical strength, air tightness, resistance to UV radiation etc.

In particular, the hinge may allow a rotation of the cover relative to the container body about a rotation axis, wherein a vertical position of the rotation axis may, in an upright position of the container, be between the apex of the sealing portion and an upper end of the peripheral body wall. Preferably, the rotation axis of the hinge may be situated radially outside of the container body. In other words, the rotation axis of the hinge may be situated perpendicularly outwardly of the wall of the container body. Such a position allows to avoid or at least limits any damaging contact between the sealing portion of the cover skirt and the upper end of the container body during opening and closing operations of the cover. The sealing portion enters the opening of the container without scraping. The hinge can be any means connecting the container body and the cover directly or indirectly and allowing a rotation or pivotal movement of the cover with respect to the container body.

Preferably, the container body may comprise a first connecting means and the cover may comprise a second connecting means integral with the hinge, wherein the container body and the cover may be detachably connected with each other by connecting the first with the second connecting means. The hinge can preferably be used for attaching a connection means to the cover.

Preferably the second connecting means may be provided with at least one snapping hook and the first connecting means may be provided with at least one recess for accommodating the snapping hook in order to connect the cover at the container body. This may provide a snap connection of cover and container which can be made by simply inserting the second connecting means into the first connecting means.

In a further preferred embodiment the first connecting means may be integral with the container body. In this case the container may consist of only two separate parts container body and cover.

Preferably the hinge may be a foil hinge. Foil hinges may be very reliable and may provide an exact rotation axis of the cover with respect to the container body. This may facilitate a very exact positioning of the cover during the closing movement which guarantees that the cover skirt with the sealing portion is not damaged during closing the cover.

In a further preferred embodiment the container may comprise an insert which may essentially cover the inner surface of the container body, wherein the insert may be made of a different material compared to the container body. By providing an insert within the container body the inner surface which contacts the stored goods can be made of an appropriate material which can be different to the material of the container body. For example it can be favourable for medical applications to produce the insert of an inert material.

Further advantages, details and characteristics result from the sub claims.

SHORT DESCRIPTION OF THE DRAWINGS

Figure 2:
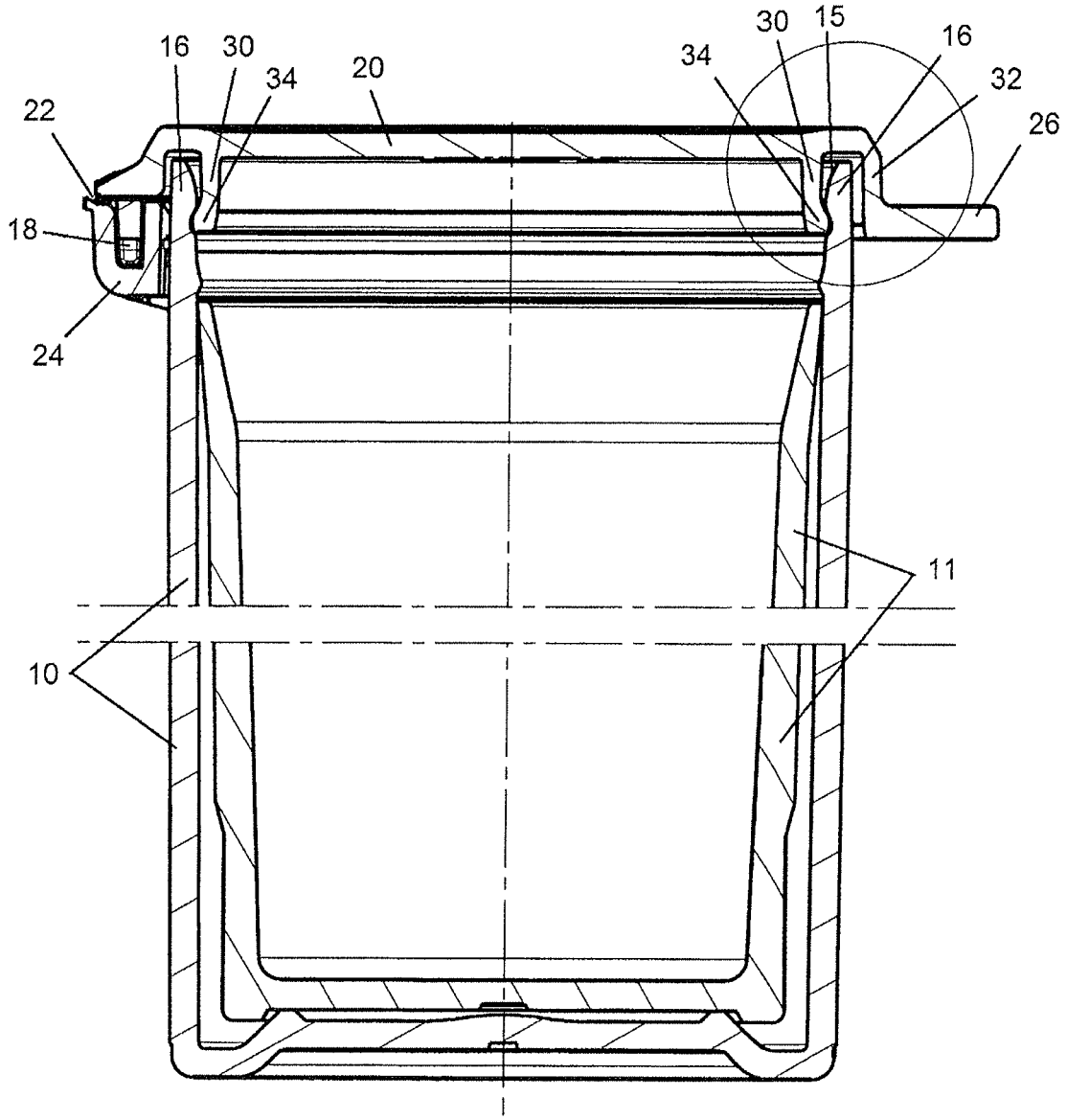
Figure 3:
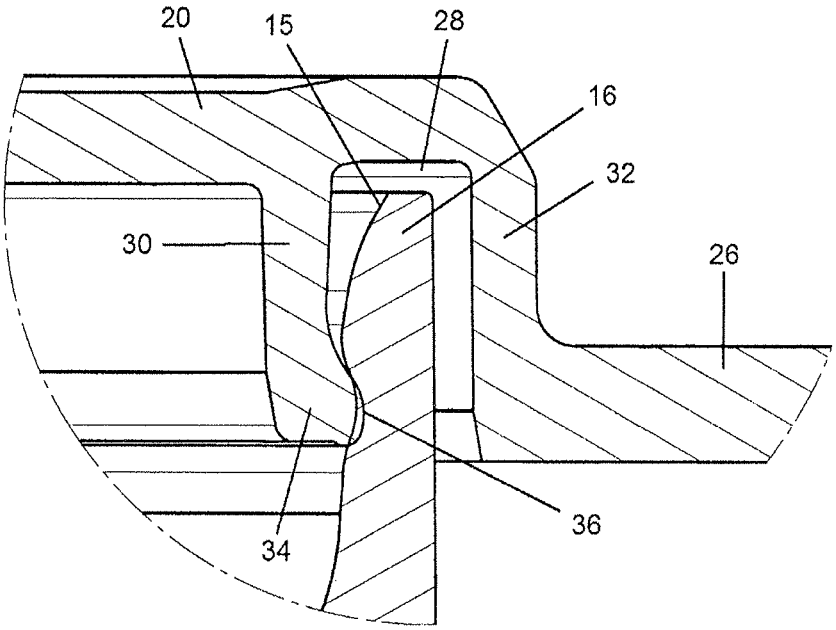
Figure 4:
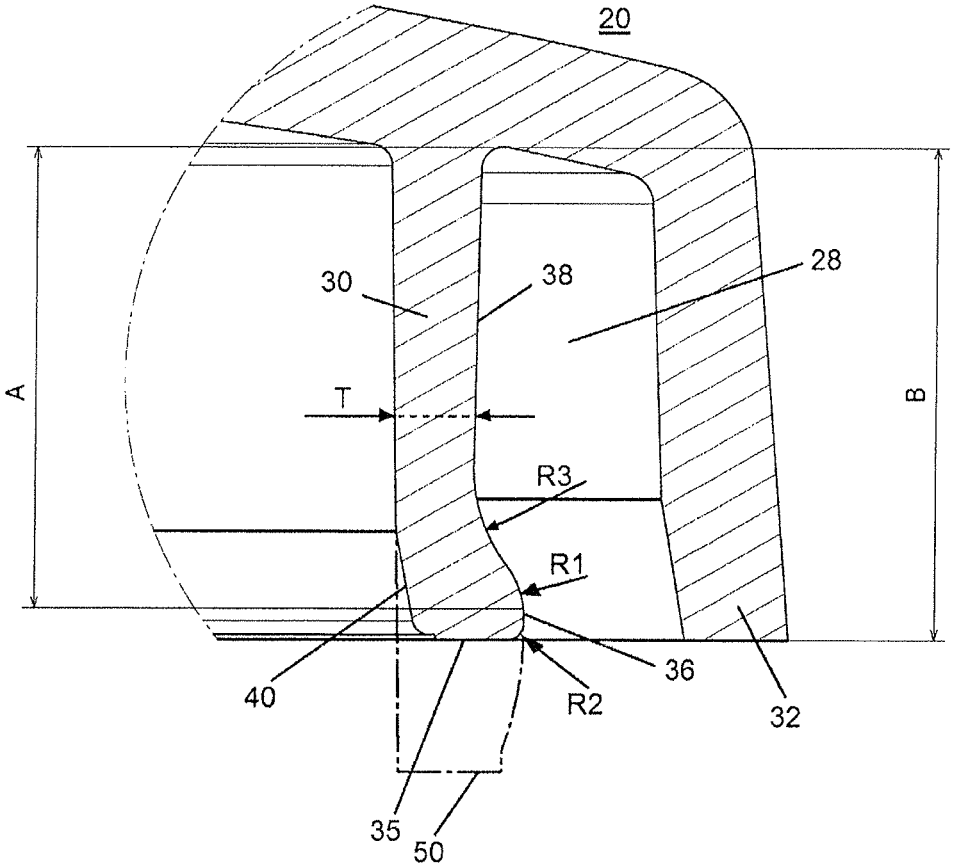
Figures 5, 6:
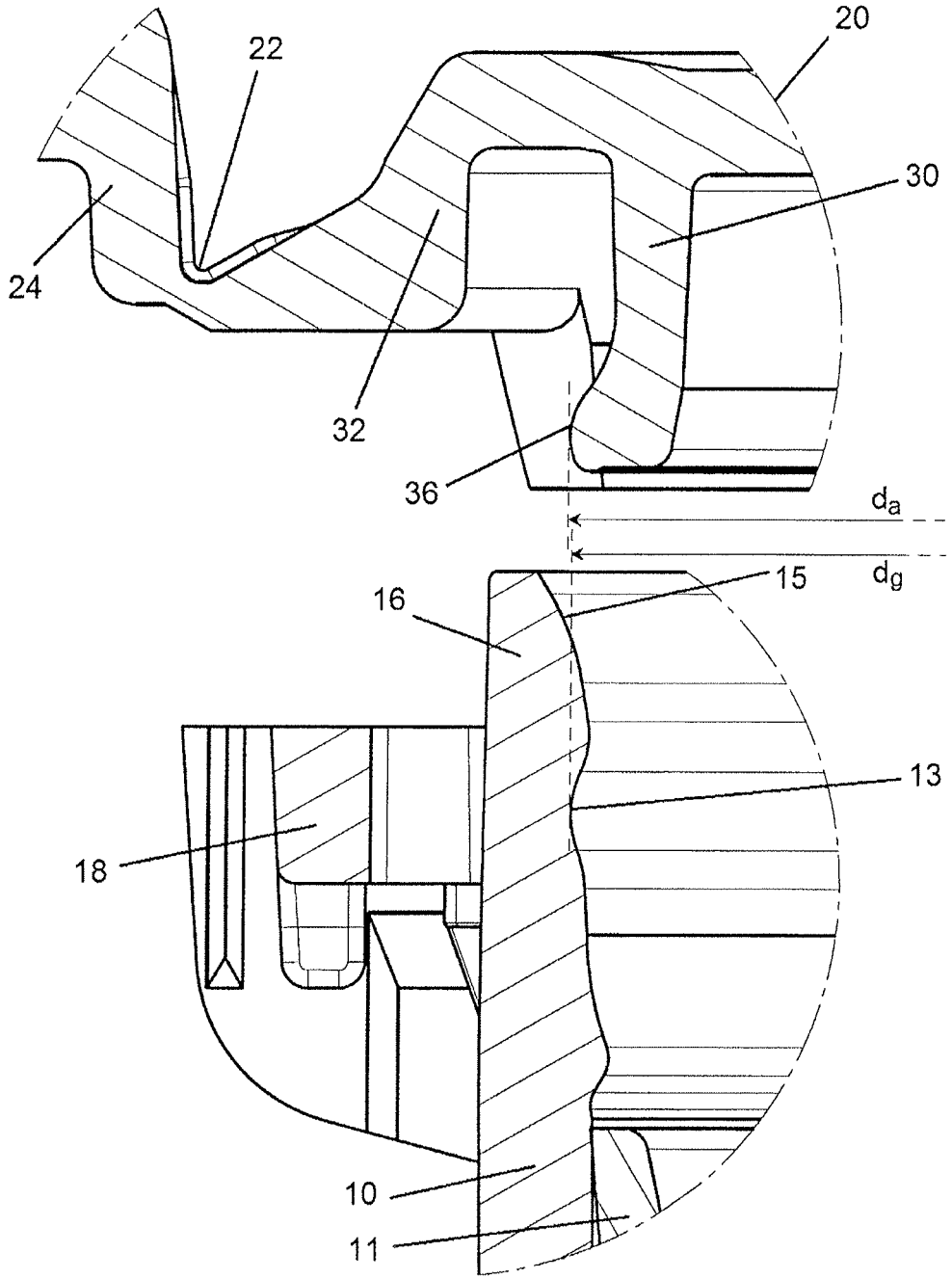

In the following the invention will be explained in more detail with reference to the figures. Therein shows:

FIG. 1 a three dimensional drawing of a container of container body and mounted cover in open condition;

FIG. 2 a lateral sectional view of the container according FIG. 1 in closed condition;

FIG. 3 a partial lateral sectional view of a part of the container, in particular a part of the cover cooperating with a part of the container body of the container according to FIGS. 1 and 2;

FIG. 4 an enlarged detail of a partial lateral sectional view of a cover according to one of FIGS. 1 to 3;

FIG. 5 a partial lateral sectional view of a part of the cover of the container according to one of FIGS. 1 to 4; and FIG. 6 a partial lateral sectional view of a part of the container body of the container according to FIG. 5.

DETAILED DESCRIPTION OF PREFERRED EMBODIMENTS

In the following preferred embodiments of the invention are shown with respect to the figures.

FIG. 1 shows an air tight container 100 according to the invention. The container 100 consists of a container body 10 and a hinged cover 20 and can be used for example to store medical goods such as test strips for blood glucose measurement. The container body 10 has an opening 12 which is surrounded by a peripheral body wall 16. The cover 20 can rotate around a foil hinge 22 for closing and opening of the container 100. A foil hinge is a flexible foil that is used as a hinge. The foil is capable of being rotated or pivoted about an axis, i. e. a rotation axis, which axis extends parallel to a plane of extension of the foil.

A bead 14 which surrounds the container body 10 extends outwards from the peripheral body wall 16 and acts as a stop for the cover 20 in closed condition.

The cover 20 is detachably connected to the container body 10 by means of a first connecting means 18 integral with the container body 10 and a second connecting means 24 integral with the hinge 22. The second connecting means 24 comprises two snapping hooks on opposite sides or one snapping hook on the total length of the hinge 22 or a combination of both which engage corresponding recesses at the first connecting means 18. To establish the connection it is just required to insert the second connecting means 24 into the first connecting means 18.

FIG. 2 shows in a partial sectional view the container in closed condition. Particularly, it shows how the air tight sealing between container body 10 and cover 20 may be established. To this end the cover 20 comprises a cylindrical cover skirt 30 which provides the only seal and, at the same time, provides the only locking element for mechanically holding the cover 20 in place and a cylindrical outer peripheral cover wall 32 which is optionally provided and may protect the seal.

The cover skirt 30 is provided with a sealing portion 34 at an outer surface of the cover skirt 30. This sealing portion 34 cooperates with an inner peripheral body groove on an inner surface of the peripheral body wall 16 of the container body 10 to both air tight seal the container and lock the cover 20 on the container body 10. In other words, the sealing portion provides for the only seal and for the only locking element acting between the cover and the container body.

For facilitating the closing of the cover 20 and to prevent any damages of the sealing portion 34 the peripheral body wall 16 is provided with a chamfer 15 at its upper inner edge. Further, the inner surface of the peripheral body wall 16 is provided very evenly and smoothly. For holding the cover 20 in place in closed condition there is no need to provide an additional projection or similar means which would engage with a corresponding protrusion on the outer surface of the peripheral body wall 16. In contrast, as an alternative to such mechanism, the present embodiment uses the sealing portion 34, which will be further specified below as comprising an apex 36, and a peripheral body groove 13, to provide both the seal and the locking element without the need of any additional protrusion or other locking mechanism. In order to open the container the cover 20 comprises a thumb tab 26 which is arranged at the outer peripheral cover wall 32. By pressing the thumb tab 26 from below, the cover 20 is opened.

The clipping of the cover 20 at the container body 10 is combined with the sealing. The seal (apex 36 of sealing portion 34) engages the inner surface of the peripheral body wall 16, more specifically an inner peripheral groove 13 provided on the inner surface of the peripheral body wall 16. This configuration provides improved holding capabilities during depression tests without substantially impacting the opening forces which means that the improved design allows for a more reliable sealing without requiring the user to apply more force to open and/or close the container.

FIG. 2 further shows an insert 11 which can be made of a special material within the container body 10. Preferably the insert 11 is made of a desiccant entrained polymer whereas the cover 20 and the container body 10 are made of PP.

FIGS. 3 to 5 show details of the cover 20, particularly the elements of the sealing portion 34 at the cover skirt 30. The sealing portion 34 comprises an apex 36 which comprises a first radius R1 and which forms the actual contact line with the inner peripheral body groove 13. The first radius R1 can be 0.5-3.0 mm, preferably 0.7-0.9 mm and more preferably it is 0.8 mm.

The apex 36 is arranged at the outer edge of the cover skirt 30 and faces the outer peripheral cover wall 32. Between the outer peripheral cover wall 32 and the cover skirt 30 a clearance 28 is provided, which accommodates the peripheral body wall 16 in closed condition of the container.

As it can be seen in FIG. 4, the vertical distance A of the apex 36 from a top wall of the cover 20 is smaller than the vertical extension B of the outer peripheral cover wall. Therefore, the outer peripheral cover wall 32 protects the apex 36 from undesired contact with other elements, what may lead to damages of the apex 36 that forms the actual sealing line. This leads to an increased reliability of the container in view of air tightness.

The vertical distance A of the apex 36 of the sealing portion 34 from the top wall of the cover 20 can be 2.0-15.0 mm, preferably 3.9 mm and the vertical extension B of the outer peripheral cover wall 32 from the top wall of the cover can be 2.1-15.1 mm, preferably 4.2 mm. Therefore, the apex 36 of the sealing portion 34 is protected by a preferably 0.3 mm higher outer peripheral cover wall 32.

The sealing portion 34 further comprises a second radius R2 between the first radius R1 and an end surface 35 of the cover skirt 30. The second radius R2 is smaller than the first radius R1. In an embodiment the second radius R2 can be 0.05-2.0 mm, preferably 0.10-0.50 mm and more preferably 0.15 mm. This second radius R2 eliminates the risk of damaging (for example scratching) the inner wall surface of the peripheral body wall of the container body 10 and, thereby, improves again airtightness of the container. Further, the small radius R2 ensures that the distance between the apex 36 and the end surface 35 is small such that the sealing line is close to the lower end of the cover skirt 30 which has manufacturing advantages. Particularly, this avoids material accumulation at the sealing portion 34 which eliminates defects like sink marks.

Further, the cover skirt 30 comprises a third radius R3 between a wall surface 38 and the sealing portion 34. This third radius R3 can be 1.0-3.0 mm more preferably 1.5 mm. It facilitates the production of the cover 20 since it avoids any risk of scratching the sealing portion surface when the cover 20 is ejected from its mould.

The thickness T of the inner wall 30 is chosen to optimize on the one hand the compression force the apex 36 exerts to the inner peripheral body groove 13. On the other hand, as mentioned above, it has been found out that it is favourable to avoid material accumulations at the sealing portion 34 since the sealing portion 34 is—time wise—the last portion of the injection mould that is filled. By reducing the wall thickness T, material accumulations are avoided and subsequently material defects like sink marks are avoided which improves the geometry of the sealing portion 34, in particular the apex 36 and the air tightness of the container. The thickness T of the cover skirt 30 can be 0.4-1.2 mm, preferably about 1.2 mm.

For this reason the cover skirt 30 further comprises a chamfer 40 opposite to the sealing portion 34, hence, on the inner side of the lower end 35 of the cover skirt 30.

Measurements within a climate chamber of moisture uptake showed a significant improvement in view of moisture ingress compared to a different container with a closure that shows a cover skirt of the shape indicated by outline 50.

FIG. 5 illustrates a partial lateral sectional view of a part of the cover 20 of the container. In the partial sectional view, the foil hinge 22 connecting the second connecting means and the outer peripheral cover wall 32 is illustrated. The axis of rotation or the axis of pivoting extends substantially perpendicularly to the paper plane and the foil hinge 22 allows a pivoting movement of the cover 20 with respect to the second connecting means 24 about that axis.

FIG. 5 illustrates the apex 36 of the sealing portion 34 to define an outer diameter da measured across the cover 20, more particularly between parts of the circumferential apex 36 which oppose across a center of the cover 20.

FIG. 6 illustrates a partial lateral sectional view of a part of the container body 10 of the container according to FIG. 5. In addition to the first connecting means 18, the outer peripheral body wall 16 and the inset 11 as well as the chamfer 15, FIG. 6 illustrates the inner peripheral body groove 13. This peripheral body groove 13 defines an outer diameter dg in generally the same way as the outer diameter da of the apex 36 of the cover 20. The outer diameter dg of the peripheral body groove 13 is defined between two parts of the circumferentially extending peripheral body groove 13 which are opposed to each other across a center of the body 10.

Preferably the outer diameters da and dg satisfy the equation da=dg+x, where x is 0.05 mm to 1.5 mm, more preferably 0.1 mm to 1 mm. This may allow for particularly well sealing characteristics while maintaining advantageous opening forces.

In order to evaluate the opening forces of vials according to the invention, a comparative test was carried out on two families of vials with identical geometry as regards the outside dimensions and the exchange surfaces, but with a different design of the seal and the locking element. Both families of vials have a cover made of polypropylene and a container body made of polyethylene. The first vial family had a seal design with a locking element comprising a protrusion behind the container, according to US 2011/0000930.

The second vial family had a seal and locking element design according to the invention.

1st Test:

Closed vials were fixed on an automated force tester (Chatillon TCD200). The thumb tab 26 was submitted to a vertical force exerted by a disc that displaces upwardly (i.e. in the opening direction of the vial). The vertical force was applied to the thumb tab at a point located at 4 mm from the end of the disc under a traction speed of 150 mm/min. The vertical force was recorded until the opening has been achieved. This test aimed at measuring the opening forces required by a user to open the cover on purpose. The aim is providing vials that are not too difficult to be opened or closed by a user, for example an elderly person.

The corresponding opening forces (N) were recorded in the table below:

| | Vials according to US 2011/0000930 | Vials according to the invention |
|---|---|---|
| Measured opening force (N) | 18 | 19 |
| | 21 | 19 |
| | 20 | 19 |
| | 20 | 21 |
| | 20 | 18 |
| | 20 | 19 |
| | | 18 |
| | | 17 |
| | | 21 |
| | | 21 |
| minimum | 18 | 17 |
| maximum | 21 | 21 |
| average | 19.5 | 19 |

2nd Test:

Closed vials half filled with a colored water were placed upside down in a vacuum bell. The pressure inside the bell was progressively decreased from 600 mbar and this depression was maintained during 5 minutes. During this test, it was observed whether the vials were opened or not or whether they leaked colored water. This test aimed at measuring the reliability of the apex and inner peripheral body groove forming, at the same time, both the seal and the locking element. It demonstrates the reliability with respect to accidental, i. e. non-purpose openings. The aim is providing a high resistance versus the urge of the depression to open the cover, i. e. the aim is withstanding a high depression for a long period of time.

The the vials according to US 2011/0000930 submitted to this test were opened after a decrease of about 450 mbar. In other words, the vials according to US 2011/0000930 did not hold a depression of more than 450 mbar for any time period.

Of the 10 vials according to the present invention submitted to this test, none have leaked before reaching a depression of 600 mbar. After having reached the depression of 600 mbar, only two vials opened after 4 minutes at the depression of 600 mbar. The others did not open at all during the 5 minutes test.

Accordingly, the present invention allows an improved holding of the cap during depression tests without substantially impacting the opening forces to be applied by a user in order to open the vial on purpose.

LIST OF REFERENCE SIGNS

10 container body
11 insert
12 opening
13 peripheral body groove
14 bead
15 chamfer
16 peripheral body wall
18 first connecting means
20 cover
22 hinge
24 second connecting means
26 thumb tab
28 clearance
30 cover skirt
32 outer peripheral cover wall
34 sealing portion
35 end surface
38 wall surface
40 chamfer
50 alternative design
100 Container
R1 first radius
R2 second radius
R3 third radius
A vertical distance of apex
B vertical extension of outer peripheral cover wall
T thickness of cover skirt

The invention claimed is:

1. A container for loosely stored products comprising a) a container body comprising a peripheral body wall having an inner peripheral body groove in an inner surface of the inner peripheral body wall;

and b) a cover comprising a cover skirt having an outwardly facing sealing portion with an apex that seals into the inner peripheral body groove when the cover is in a closed condition thereby forming a seal which is a sealing line;

wherein the apex of the cover skirt and the inner peripheral body groove provide the only seal between the cover and the container body when the container is in the closed condition;

wherein the peripheral body groove defines a groove radius in a cross section of the peripheral body wall and the apex of the sealing portion defines an apex radius in a cross section of the cover skirt;

wherein the groove radius is greater than the apex radius, and wherein the apex of the cover skirt and the inner peripheral body groove additionally provide a locking element that holds the cover in the closed condition on the container body, wherein the locking element is the only locking element that holds the cover in a closed condition on the container body.

2. The container of claim 1, wherein the cover further comprises an outer peripheral cover wall situated radially outside of the cover skirt and radially outside of the peripheral body wall.

3. The container of claim 2, wherein the cover further comprises a top wall from which the cover skirt and the outer peripheral cover wall extend, wherein a vertical distance of the apex of the sealing portion of the cover wall from the top wall is smaller than a vertical extension of the outer peripheral cover wall.

4. The container of claim 1, wherein the peripheral body wall has, when viewed from a top side, rounded surfaces.

5. The container of claim 1, wherein the container body has a cylindrical shape.

6. The container of claim 1, wherein the inner peripheral body groove has a depth of between 0.05 mm and 0.7 mm.

7. The container of claim 1, wherein a skirt outer diameter (da) of the cover skirt at a position of the apex is greater than a peripheral body wall inner diameter (dg) of the container body at a position of the peripheral body groove.

8. The container of claim 7, wherein the skirt outer diameter (da) and the peripheral body wall inner diameter (dg) satisfy the equation da=dg+x, where x is from 0.05 mm to 1.5 mm.

9. The container of claim 1, further comprising a hinge connecting the container body and the cover, wherein the hinge allows a rotation of the cover relative to the container body about a rotation axis, and wherein a vertical position of the rotation axis is, in an upright position of the container, between the apex of the sealing portion and an upper end of the peripheral body wall.

10. The container of claim 9, wherein the rotation axis of the hinge is situated radially outside of the container body.

11. The container of claim 1, wherein the cover is detachably connected to the container body.

12. The container of claim 1, wherein the cover skirt is a separate piece of the cover.

13. The container of claim 4, wherein a shape of the rounded surface of the peripheral body wall is selected from the group consisting of oval and circular.

14. The container of claim 1, wherein the container, when closed, holds a depression of more than 600 mbar without opening.

* * * * *